US007296698B2

(12) United States Patent
McClure

(10) Patent No.: US 7,296,698 B2
(45) Date of Patent: Nov. 20, 2007

(54) STACKABLE SHELF

(75) Inventor: Jack A. McClure, Omaha, NE (US)

(73) Assignee: Weyerhaeuser Company, Federal Way, WA (US)

( * ) Notice: Subject to any disclaimer, the term of this patent is extended or adjusted under 35 U.S.C. 154(b) by 252 days.

(21) Appl. No.: 10/969,132

(22) Filed: Oct. 19, 2004

(65) Prior Publication Data

US 2006/0081550 A1 Apr. 20, 2006

(51) Int. Cl.
*A47B 43/00* (2006.01)

(52) U.S. Cl. ..... 211/188; 211/188; 211/194; 211/49.1; 211/50; 206/516; 206/821

(58) Field of Classification Search ..... 211/188, 211/194, 49.1, 50, 44, 45, 70.1, 72, 73, 135, 211/59.4; 108/51.3; 206/561, 821, 764, 206/600, 386
See application file for complete search history.

(56) References Cited

U.S. PATENT DOCUMENTS 2,360,218 A * 10/1944 Gavin ..... 206/449
2,908,464 A * 10/1959 Traudt et al. ..... 108/51.3
3,041,029 A * 6/1962 Brown ..... 108/51.3
3,115,376 A * 12/1963 Cupo ..... 312/35
3,433,401 A * 3/1969 Swift ..... 229/120.11
3,480,196 A * 11/1969 Simas ..... 206/598
4,197,788 A * 4/1980 Wharton, Jr. ..... 493/59
5,000,376 A * 3/1991 Wojdyla ..... 410/118
5,484,241 A * 1/1996 Haywood et al. ..... 410/154
6,457,421 B1 * 10/2002 Apichom ..... 108/44

OTHER PUBLICATIONS

WP, "Shelf," schematic figure, IBP Co., Nov. 1999.

* cited by examiner

*Primary Examiner*—Richard E. Chilcot, Jr.
*Assistant Examiner*—Lindsay M. Maguire
(74) *Attorney, Agent, or Firm*—Christensen O'Connor Johnson Kindness

(57) ABSTRACT

A blank for a stackable shelf and the shelf formed from it. The blank comprises a substantially rectangular shelf member having attached walls. Each of the sidewalls has an integral extension which extends into and is detachable from the shelf member. The height of the integral extension is greater than the height of the side wall. Each of the integral extensions has a transverse score line which divides the extension into an upper and a lower section. The height of the lower section is substantially equal to the height of said side wall.

13 Claims, 15 Drawing Sheets

STACKABLE SHELF

This is directed to a blank for a stackable shelf and the formed shelf.

Some products, such as prepackaged meat or chicken, are shipped as units. It is necessary to have several layers of these units in a container. There usually are a plurality of units in each layer. The layers need to be separated so that the units in the lower layers are not crushed by the weight of the units in the upper layers.

One embodiment of the present invention is a blank for a shelf which can separate these layers. Another embodiment is a stack of shelves formed from this blank. Another embodiment is a blank for a shelf which has an integral support post. Another embodiment is a stack of shelves formed from this blank.

In use, the product units are placed on the bottom of a container and the shelf is placed over the units. The shelf has side walls that extend downwardly around the product and rest on the container bottom wall supporting the shelf. If the shelf has an integral post, the post will extend downwardly and rest on the container bottom wall supporting the shelf. If a separate support member is used, it will be placed on the container bottom wall supporting the shelf. Another layer of product units will be placed on the shelf. If there is a separate support member it will also be placed on the shelf. The next shelf will then be placed on the first shelf and be supported by its side walls and either the separate support member or the integral support post.

The downwardly extending side walls have upward extensions which may act to guide the side walls of the next upper shelf into place, or as handles to pull a shelf from the container at the place of use.

Figure 1:
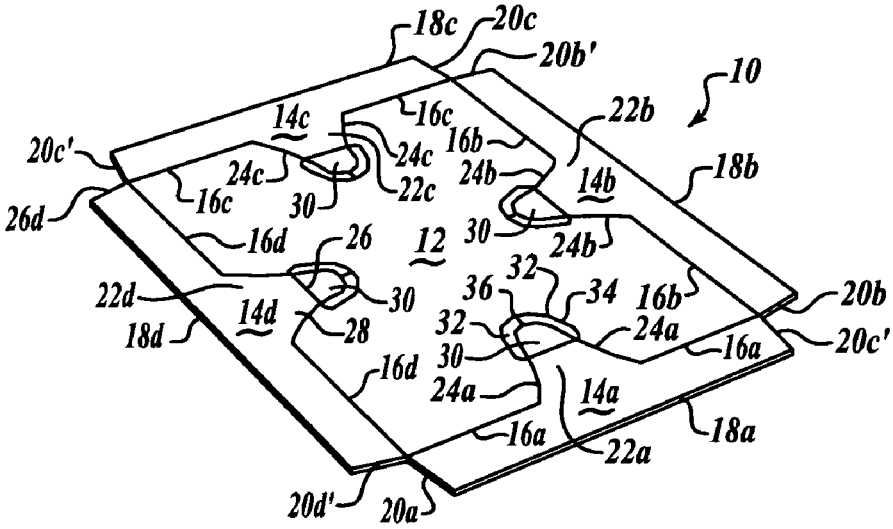
FIG. 1 is an isometric view showing the blank for an embodiment of the shelf.

In FIG. 1 the shelf blank 10 has a central shelf member 12 and four side walls 14*a-d* attached and hinged to the central shelf member 12 by score lines 16*a-d*. Each of the side walls 14*a-d* has an outer bottom edge 18 and side edges 20 and 20'. The height of each of the side walls 14, the distance between the score line 16 and the bottom edge 18, is substantially equal so that each of the bottom edges 18 can provide support for the shelf member 12 in the erected shelf. The side edges 20 and 20' of each side wall 14 are separated from the side edges 20 or 20' of an adjacent side wall 14. In one embodiment the side edges 20 and 20' of a side wall 14 are substantially aligned with the score lines 16 of the adjacent side walls. In another embodiment they are beveled inwardly from the line of score lines 16.

The side walls 14*a-d* have integral inward extensions 22*a-d* which are detachable from the central shelf member 12 by lines 24. Lines 24 can be cut lines, cut and score lines or perforations. A transverse score line 26 extends across extension 22 and divides it into a lower section 28 and an upper section 30. The score line 26 of an extension 22 is substantially parallel to the score lines 16 which attach the side wall 14 integral the extension 22 to the shelf member 12. The perpendicular distance between the score line 26 and the score line 16 is substantially equal to the perpendicular distance between the score line 16 and the bottom edge 18.

The shelf member 12 has a pair of elements 32 which surround the upper section 30. These elements 32 are formed by lines 34 and a cut line 36. The lines 34 can be cut lines, score lines, cut and score lines or perforations. These elements 32 allow the upper sections 30 to be grasped and rotated upwardly to detach the extension 22 from the shelf member 12 when forming the shelf.

FIG. 1 also shows the blank for one style of separate support member. An H style support member is shown. Any type of separate support member can be used. The blank 40 is divided into three sections by transverse score lines 42. The blank is also divided into two halves by a central longitudinal score line 44 extending between the score lines 42, and central longitudinal cut lines 46 which are aligned with and extend from the score lines 42 to the outer edges 48 of the blank.

Figure 2:
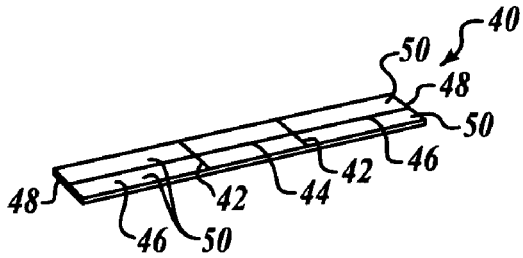
FIG. 2 is an isometric view showing the blank for a separate support member.

The H support member is formed by folding the blank 40 around the longitudinal score line 44 and bending the end sections 50 outwardly around the score lines 42 to form the support member 52. This is shown in FIG. 2. The height of the support member is substantially equal to the height of the side walls.

Figure 3:
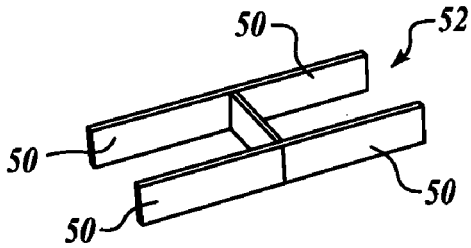
FIGS. 3-7 are isometric views showing the formation of the separate support member and shelf and the stacking of the support members and shelves.
Figure 4:
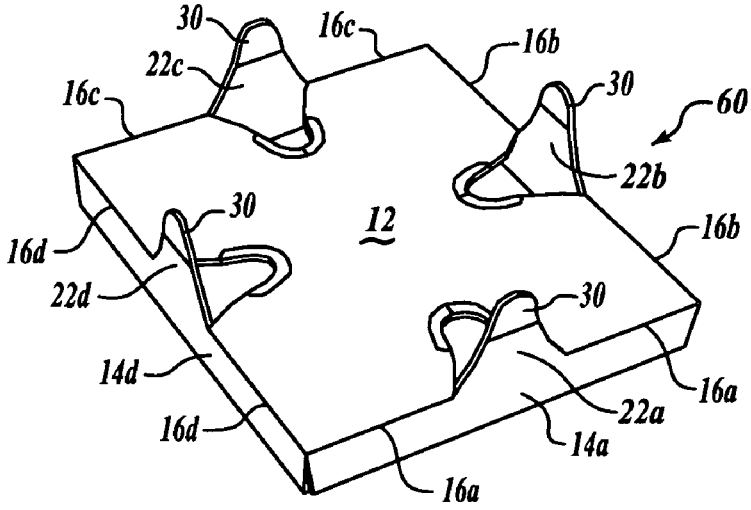
Figure 5:
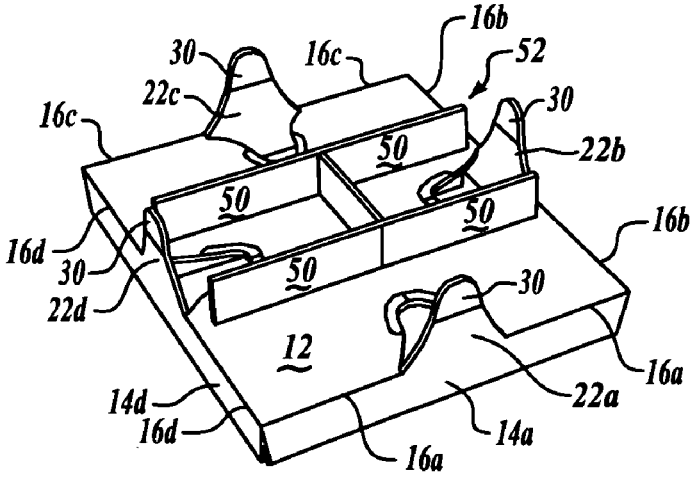
Figure 6:
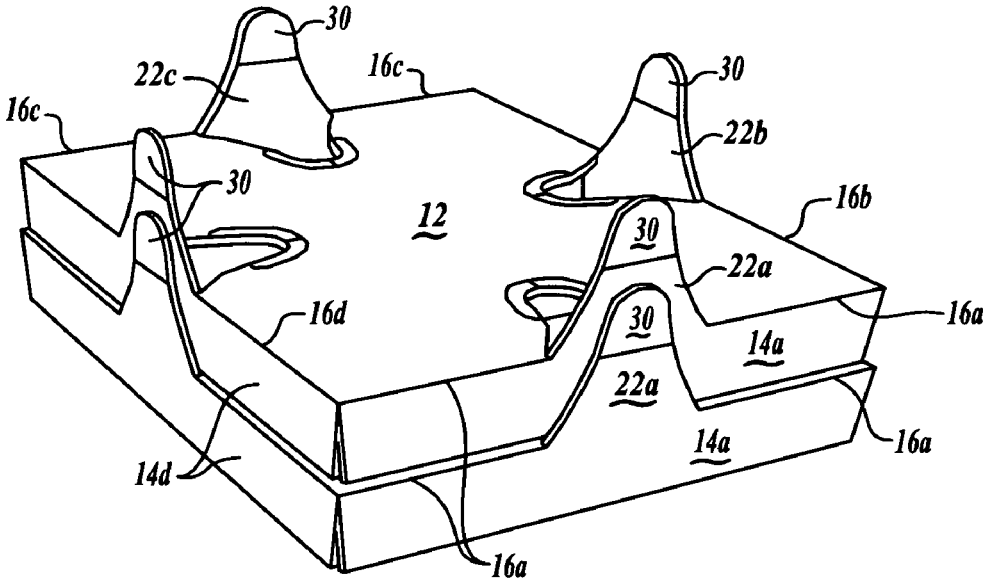
Figure 7:
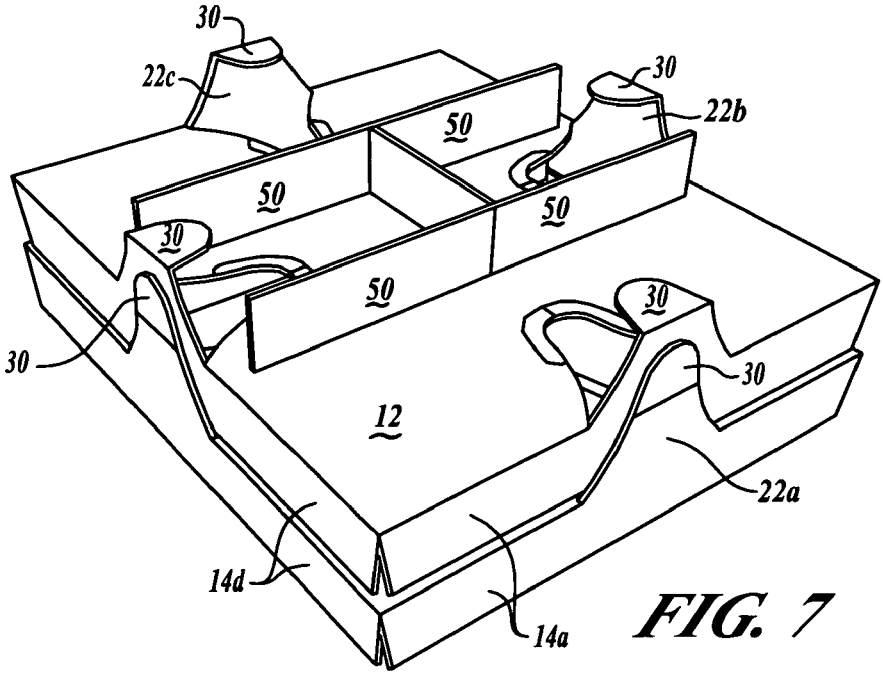
Figure 8:
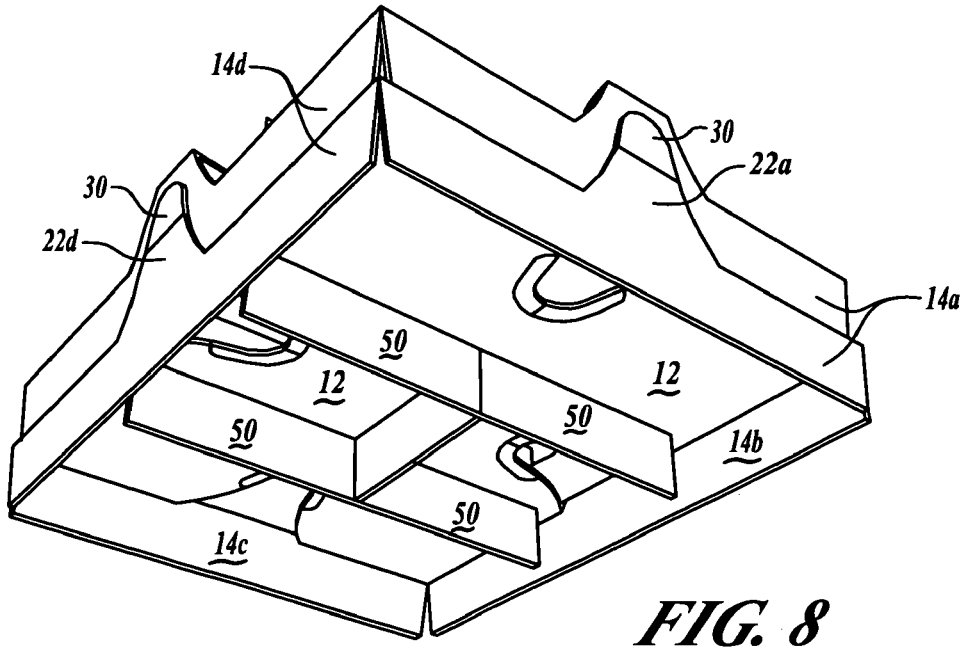
FIG. 8 is an isometric view showing the underside of the shelf with a separate support member in place.
Figure 9:
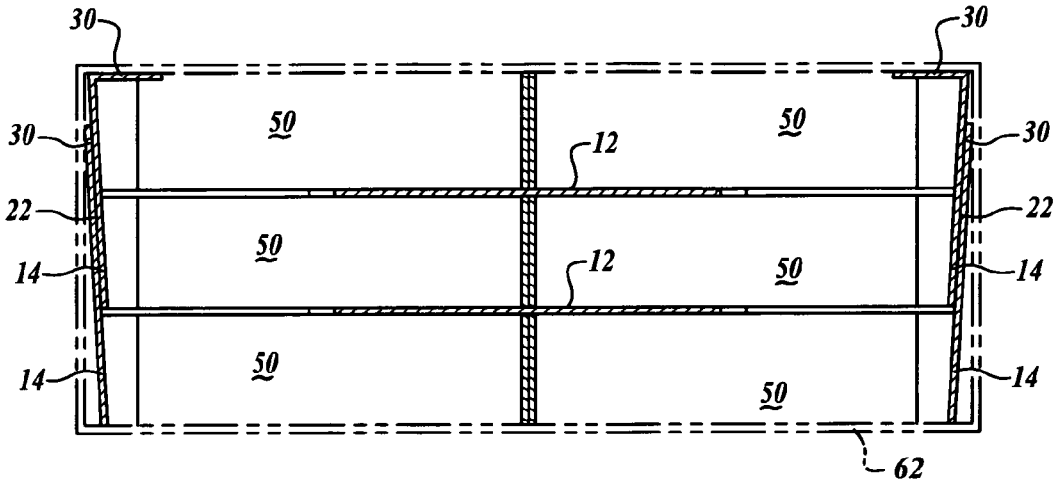
FIG. 9 is an isometric cutaway view of a container with the shelves and separate support members in place.
Figure 10:
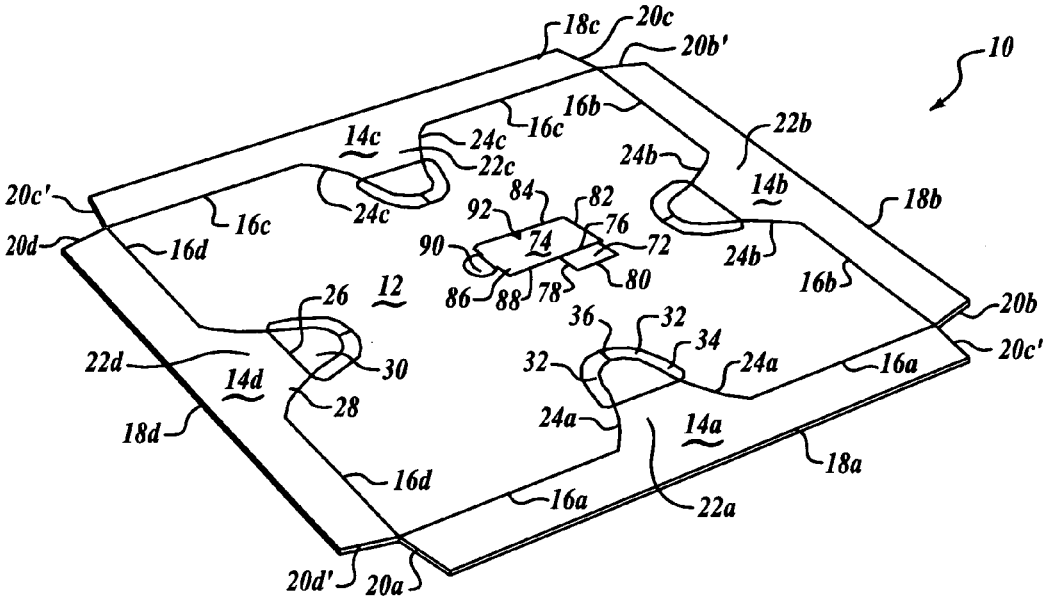
FIG. 10 is an isometric view showing the blank for another embodiment of the shelf.
Figure 11:
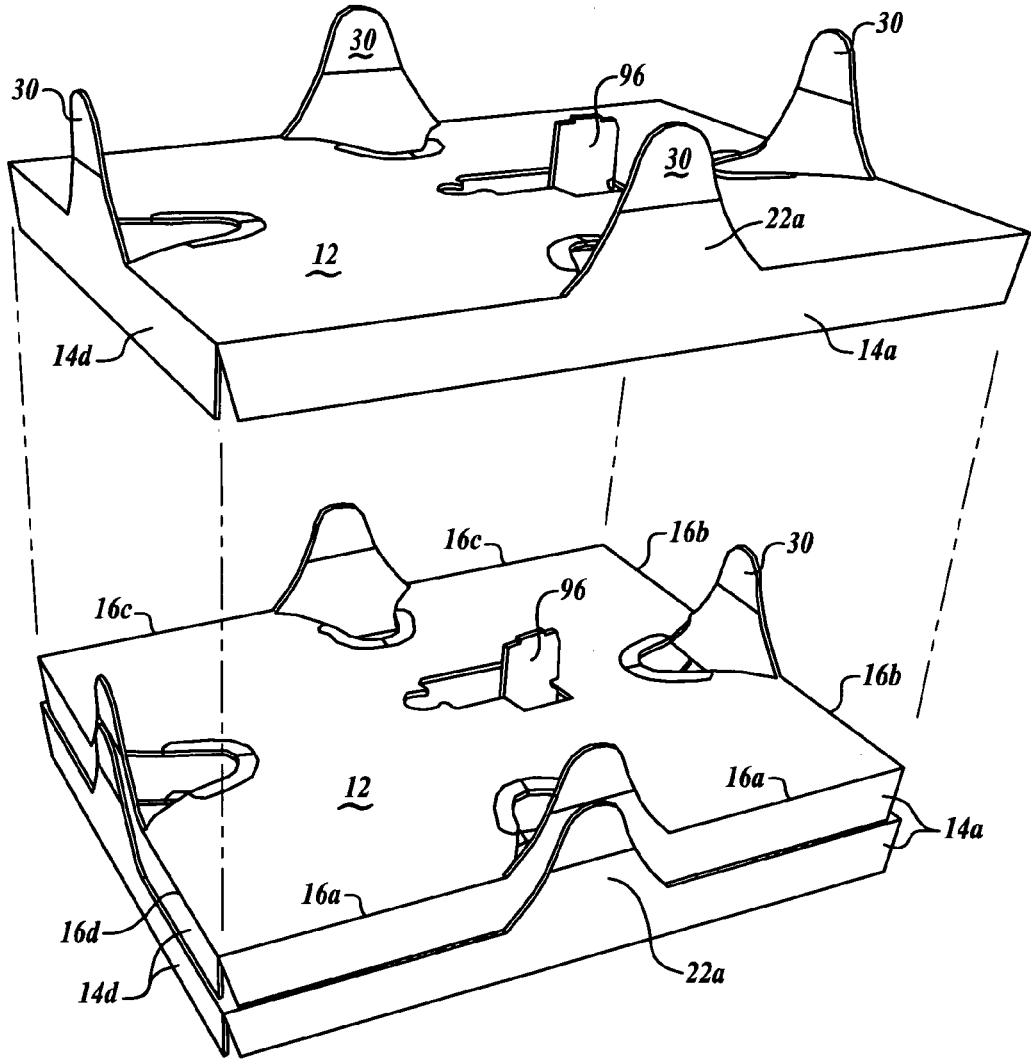
FIGS. 11-13 are isometric views showing the formation and stacking of the shelves.
Figure 12:
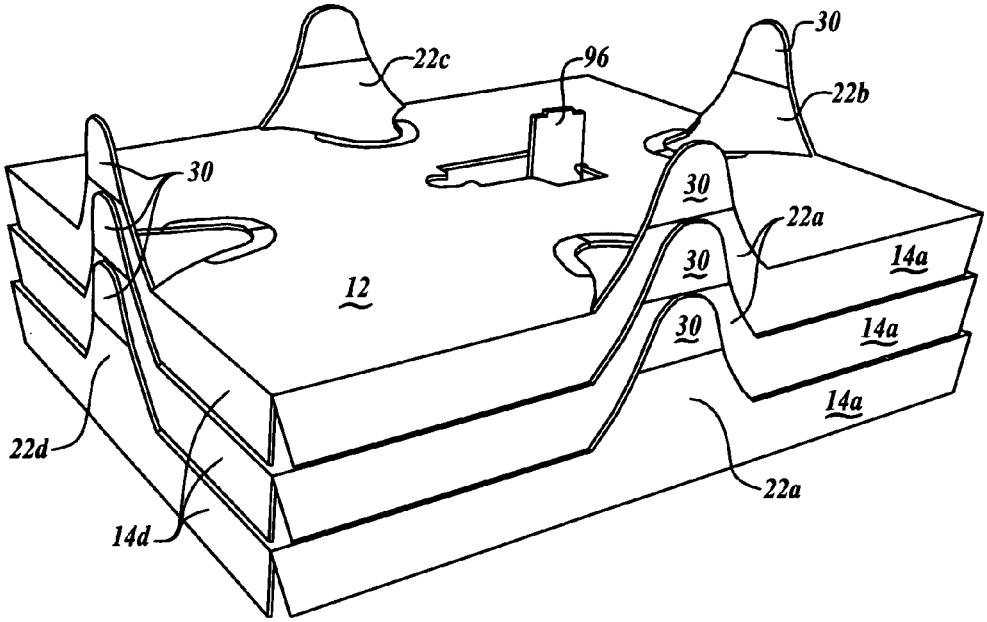
Figure 13:
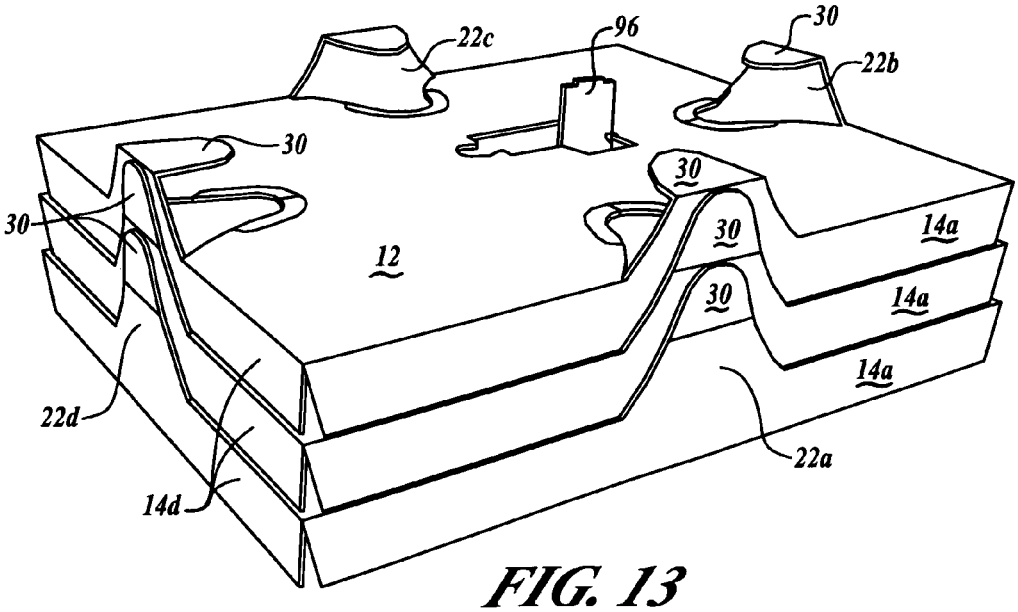
Figure 14:
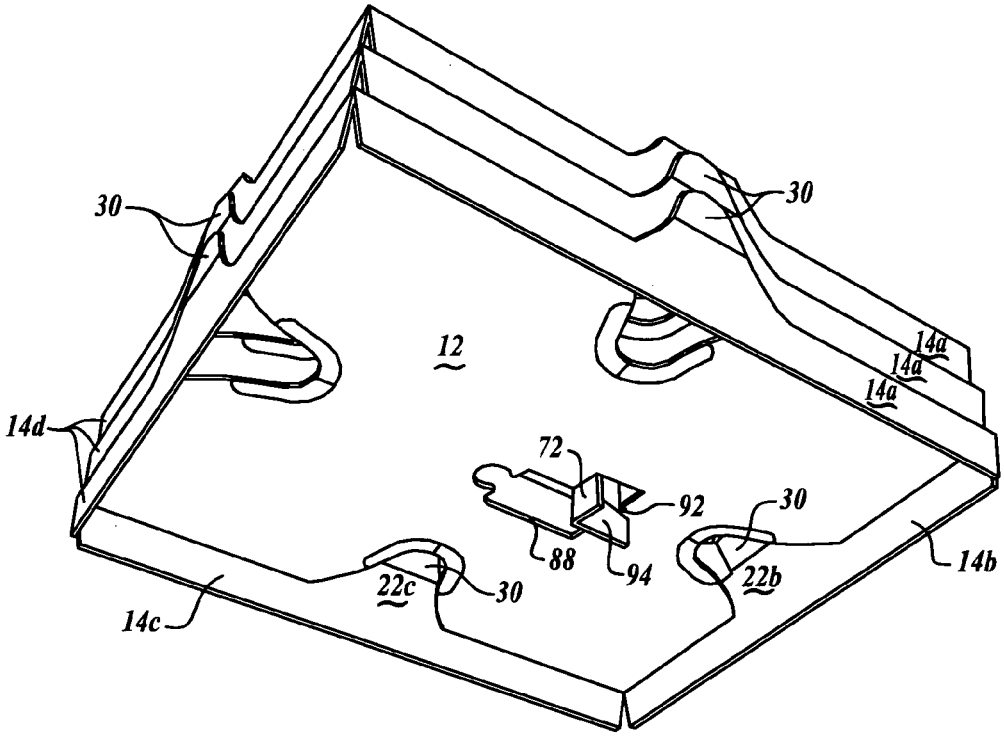
FIG. 14 is an isometric view showing the underside of this embodiment.
Figure 15:
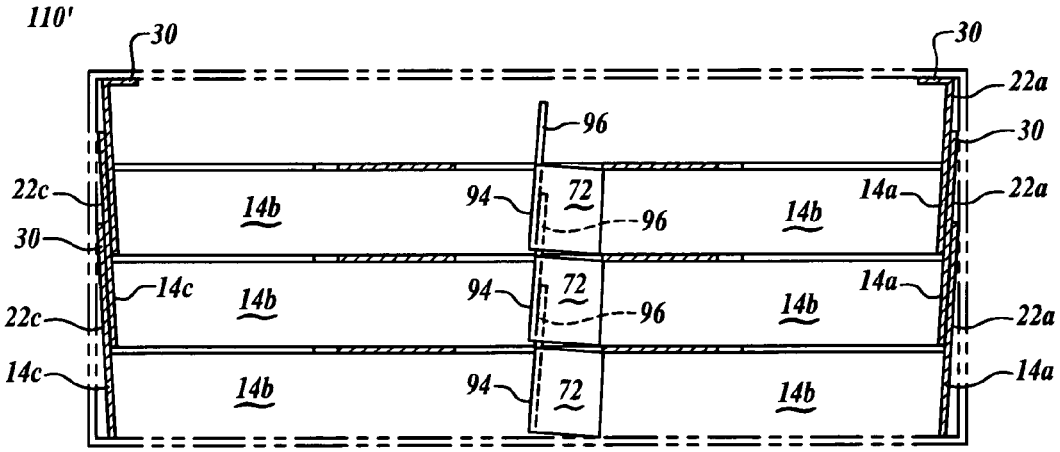
FIG. 15 is an isometric cutaway view of a container with the shelves of FIG. 10 in place.

A shelf 60 is formed by rotating each of the extensions 22 upwardly around score lines 16, detaching the extensions 22 from the shelf member 12. The inward extensions of the blank become upward extensions in the formed shelf. The side walls 14 then extend downwardly from the shelf member 12. This is shown in FIG. 3.

In using the stacking shelf, the product units and the separate support member 52 are placed on the bottom of the container 62. The shelf 60 is formed and placed over the product units and the separate support member 52. The shelf member 12 is held above the product units by the side walls 14 and the separate support member 52. Another layer of product units and another separate support member 52 are placed on the shelf member 12. When the top of the container is reached, the upper sections 30 are bent downwardly around the score lines 26 to allow the top of the container to be closed.

Two shelves 60 are shown. The actual number of shelves 60 will depend on the height of the container and the height of the side walls 14.

Another embodiment is shown in FIGS. 10-15. This embodiment uses an integral support post. Except for the support post, the reference numerals for the shelf and the relationship among elements of the shelf are the same as for the first embodiment.

For example, the blank has a shelf member 12', side walls 14*a'*-14*d'*, inward extensions 22*a'*-22*d* having lower sections

28*a*'-28*d*' and upper sections 30*a*'-30*d*', and the dimensional relationships between the score lines and edges are the same as in the first embodiment.

The support post 70 is formed of a support member 72 and a post member 74. The members 72 and 74 are attached by score line 76 and the support member is attached to the shelf member 12 by score line 78. The edges 80, 82, 84, 86 and 88 of members 72 and 74 are formed by cut lines, cut and score lines or perforations in shelf member 12. The support member 72 and post member 74 can be detached from the shelf member 12 along these edges. An aperture 90 is formed at edge 86 to allow the post member 74 to be grasped and rotated upwardly around score line 78. A notch 92 is formed in edge 84. The notch is aligned with score line 78.

The support post 70 is formed by grasping the post member 74 at edge 86 and rotating the member 74 upwardly around score line 78. If necessary, the edges 80-88 are detached from shelf member 12 prior to rotating the member 74 upwardly. Otherwise, the edges will detach during the rotating process. The post member is then bent inwardly around score line 76 and the post member is fixed in place by fixing the notch 92 to the shelf member 12. The post member 74 extends through the aperture 98 formed by the post when it is detached from the shelf member 12. The post member 74 has a lower post section 94 and an upper post section 96. In some embodiments, in the erected shelf 60' the lower edge 82 of the lower post section 94 is substantially aligned with bottom edge 18 of the side walls 14. In some embodiment of the erected shelf 60' the upper edge 86 of the upper post section 96 is aligned with the score lines 26'. In other embodiments of the erected shelf 60' the upper edge 86 is below the plane of the score lines 26'.

In some embodiments the height of the lower support member, the distance between the score line 78 and the edge 82, is substantially equal to the height of the side walls 14.

In using the stacking shelf, the product units are placed in the bottom of the container 62'. The shelf 60' is formed and placed over the product units. The lower post section 94 and the support member 72 are among the product units and rest on the bottom of the container. The bottom edges 18' of the side walls 14' of the shelf 60' rest on the bottom of the container Another layer of product units is placed on the shelf member 12' of the shelf 60' and another shelf 60' is placed over the product units. When the top of the container is reached, the upper sections 30' are bent downwardly around the score lines 26' to allow the top of the container to be closed.

Three shelves 60' are shown. The actual number of shelves 60' will depend on the height of the container and the height of the side walls 14'.

Figure 16:
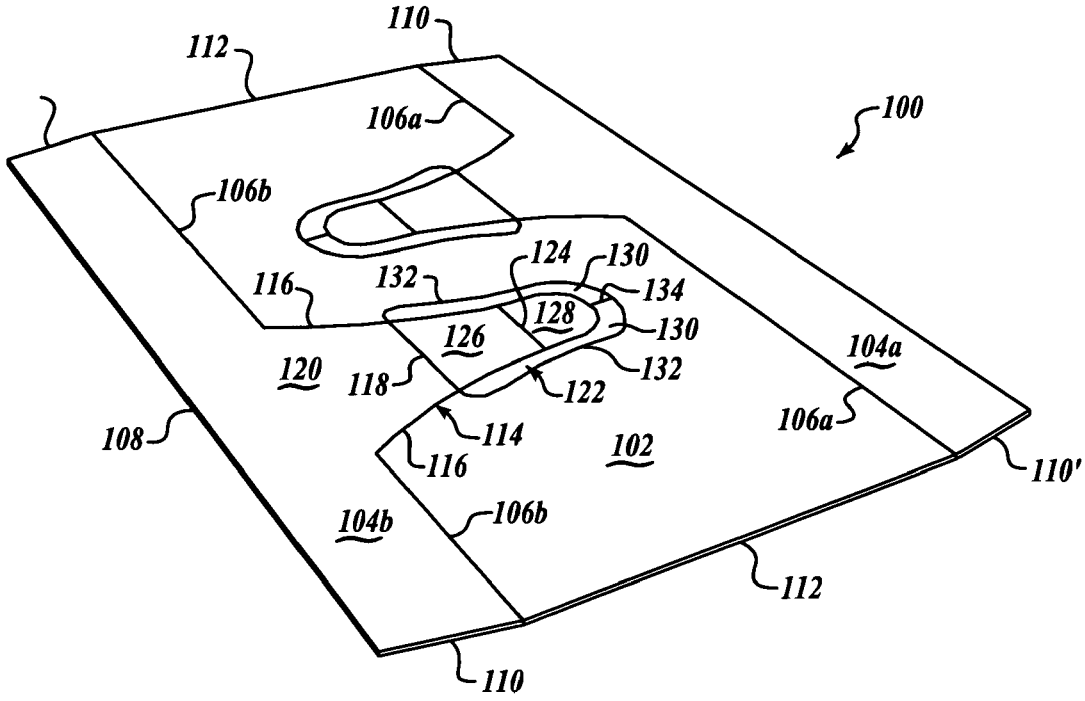
FIG. 16 is an isometric view a blank showing another embodiment of the shelf.
Figure 17:
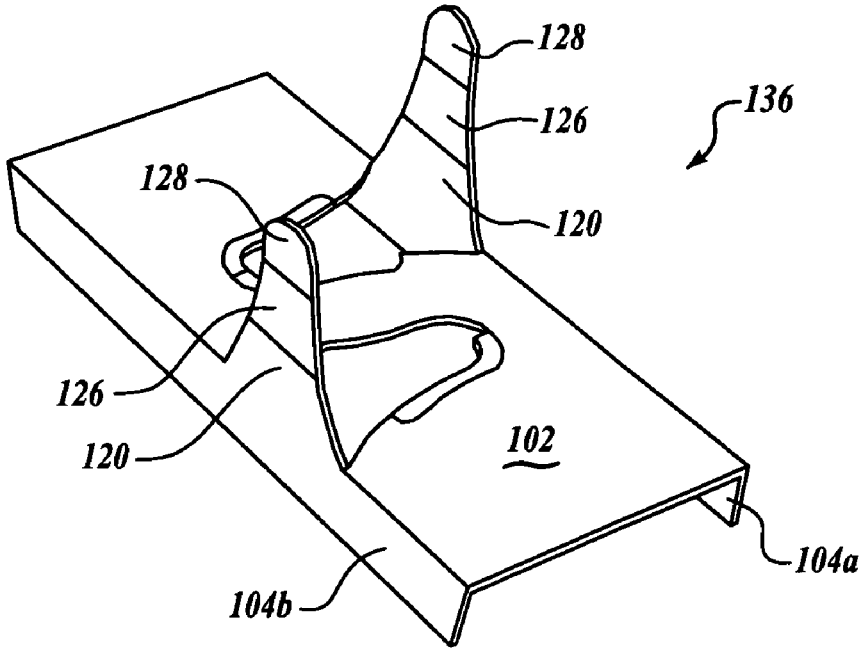
FIGS. 17-19 are isometric views showing the formation and stacking of the shelves.
Figure 18:
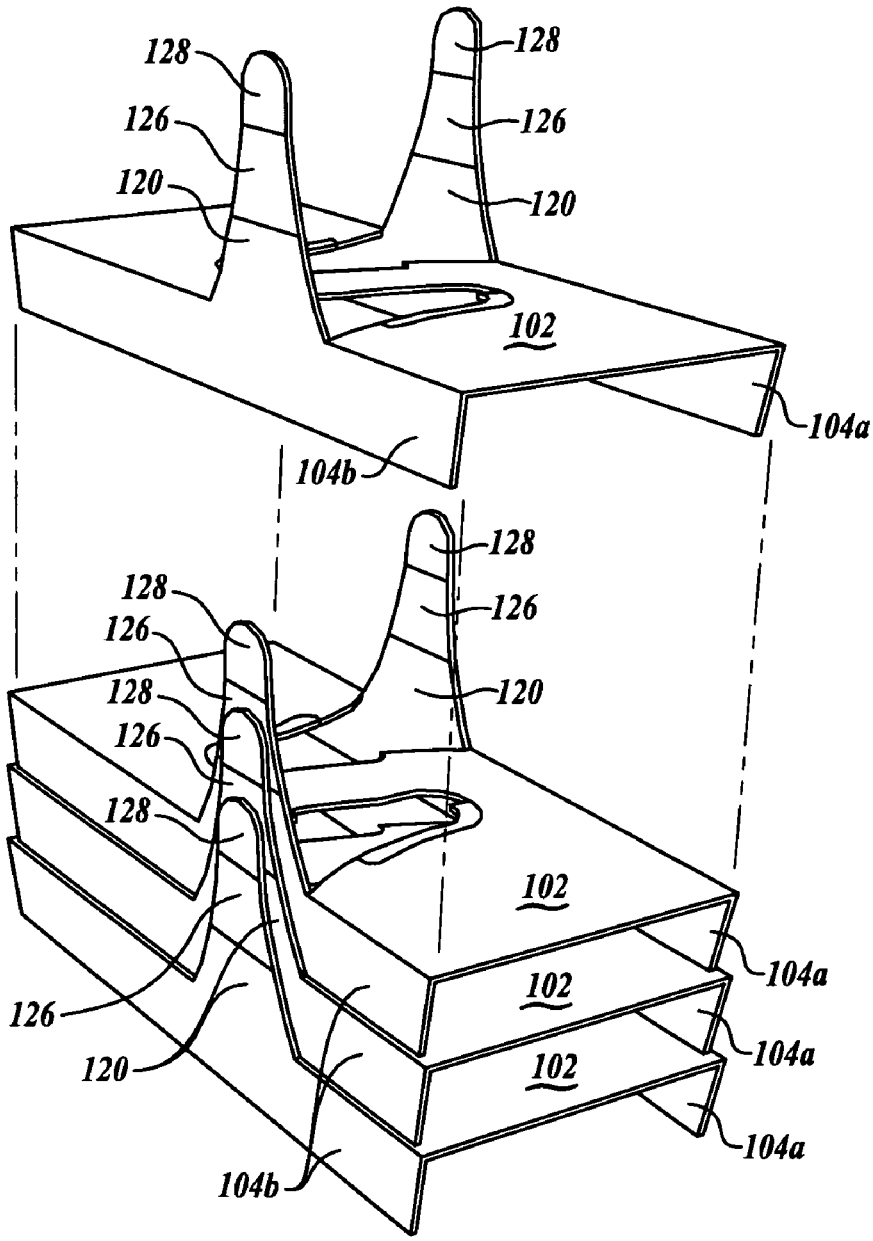
Figure 19:
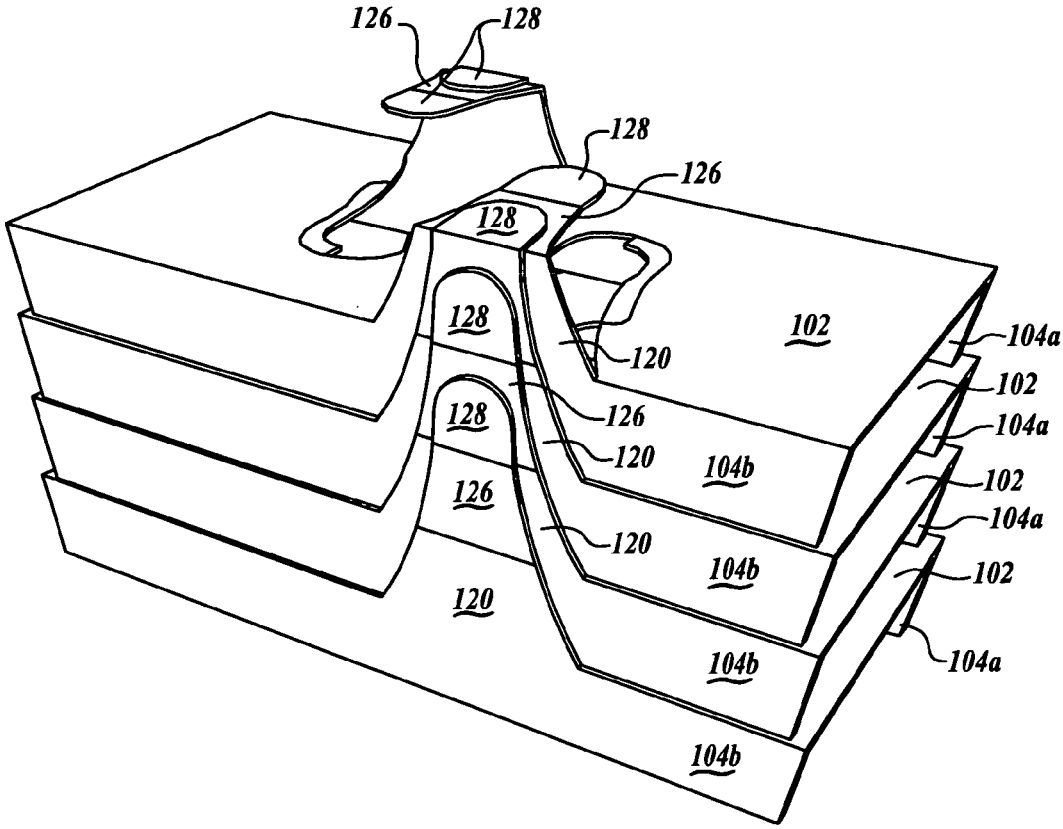
Figure 20:
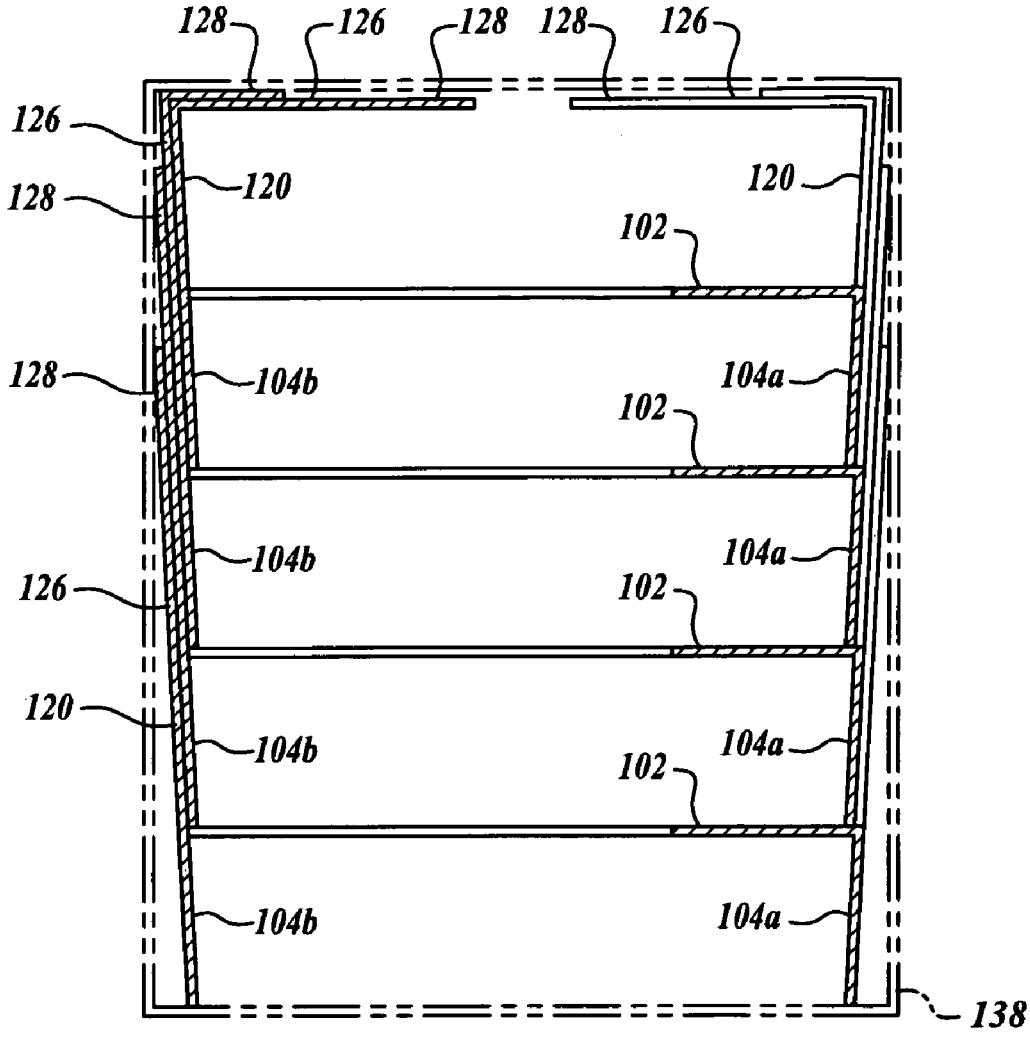
FIG. 20 is an isometric cutaway view of a container with the shelves of FIG. 17 in place.

FIG. 16 illustrates other embodiments of the shelf. In certain containers there may be no need for a separate support member or a support post or four side walls.

In FIG. 16 the shelf blank 100 has a central shelf member 102 and two opposed side walls 104*a-b* attached and hinged to the central shelf member 102 by score lines 106*a-b*. Each of the side walls 104*a-d* has an outer bottom edge 108 and side edges 110 and 110'. The height of each of the side walls 104, the distance between the score line 106 and the bottom edge 108, is substantially equal so that each of the bottom edges 108 can provide support for the shelf member 102 in the erected shelf In one embodiment the side edges 110 and 110' of a side wall 104 are substantially aligned with the side edges 112 of shelf member 102. In another embodiment they are beveled inwardly from the line of side edges 112.

FIG. 16 also illustrates another embodiment of the integral extension. The side walls 104*a-b* have integral inward extensions 114*a-b* which are detachable from the central shelf member 102 by lines 116. Lines 116 can be cut lines, cut and score lines or perforations. A transverse score line 118 extends across extension 114 and divides it into a lower section 120 and an upper section 122. A second transverse score line 124 extends across extension 114 and divides upper section 122 into an intermediate section 126 and an outer section 128. The score lines 118 and 124 are substantially parallel to the score lines 106. The perpendicular distance between the score line 118 and the score line 16 is substantially equal to the perpendicular distance between the score line 16 and the bottom edge 18. The perpendicular distance between the score line 118 and the score line 124 is also substantially equal to the perpendicular distance between the score line 16 and the bottom edge 18. The score line 118 is at the height of one erected shelf above shelf member 102 and the score line 124 is at the height of two erected shelves above shelf member 102.

An additional embodiment of the extensions 114 is also illustrated. In the earlier illustrations the extensions 22 extending from opposed sides were aligned. In this illustration the extensions 114 from the opposed sides are not aligned. They also overlap in the shelf member 102.

The shelf member 12 has a pair of elements 130 which surrounds the upper section 122. These elements 130 are formed by lines 132 and 134. The lines 130 can be cut lines, score lines, cut and score lines or perforations. The line 134 would normally be a cut line or a perforation. These elements 130 allow the extension 114 to be grasped and rotated upwardly to detach the extension 114 from the shelf member 102 when forming the shelf 136.

In using the stacking shelf, the product units are placed on the bottom of the container 138. The shelf 136 is formed and placed over the product units. The shelf member 12 is held above the product units by the side walls 104. Another layer of product units is placed on the shelf member 12. When the top of the container is reached, the upper section 122 of each extension 114 of the upper shelf 136 is bent downwardly around score line 118, and the outer section 128 of each extension 114 of the shelf 136 immediately below the upper shelf is bent downwardly around the score lines 124 to allow the top of the container to be closed.

In one embodiment the blank is made from single or double wall corrugated board material. In another embodiment it can be made from single face corrugated material. In another embodiment it can be made of paperboard.

The shelf members have been depicted as being substantially rectangular but it will be understood that substantially rectangular as used herein will include shelf members that are hexagonal in nature with beveled corners and shelf members with rounded corners.

While several embodiments of the invention have been illustrated and described, it will be appreciated that various changes can be made therein without departing from the spirit and scope of the invention.

I claim:

1. A blank comprising a substantially rectangular shelf member having side edges, side walls, each of said side walls having an integral extension, said side walls being attached to said side edges of said shelf member by score lines, each of said side walls having a height which is perpendicular to said score line which attaches said side wall to said shelf member;

the heights of said side walls being substantially equal, each said integral extension being formed in the shelf member by lines which allows each said integral extension to be detachable from said shelf member, each of said integral extensions having a height which is perpendicular to the score line which attaches said side wall integral to said extension to said shelf member, the height of said integral extension being greater than the height of said side wall, each of said integral extensions having a transverse score line which divides said integral extension into an upper and a lower section, said score line being substantially parallel to said score line which attaches said integral extension to said shelf member, said lower section having a height which is perpendicular to the score line which attaches said integral extension's side wall to said shelf member, the height of said lower section being substantially equal to the height of said side wall.

2. The blank of claim 1 wherein said side wails extend from two opposed sides of said shelf member.

3. The blank of claim 2 wherein said integral extensions are aligned across said shelf member.

4. The blank of claim 2 wherein said extensions overlap in said shelf member.

5. The blank of claim 1 further comprising each of said integral extensions having a second transverse score line which divides said upper section into an intermediate and an outer section, said score line being substantially parallel to said score lines which attach said side wall integral with said extension to said shelf member, said intermediate section having a height which is perpendicular to the score line which attaches said integral extension's side wall to said shelf member, the height of said intermediate section being substantially equal to the height of said side wall.

6. The blank of claim 1 further comprising a support post formed in said shelf member, said support post comprising a substantially rectangular support member having an upper edge attached to said shelf member by a score line, and a side and lower edge that are detachable from said shelf member, a substantially rectangular post member that is attached along a side edge to said support member by a score line, said post member having a lower edge, a side edge opposite said score line between said post member and said support member, a top edge and a side edge that is in substantial alignment with said score line between said post member and said support member, said edges being detachable from said shelf member, said post member having a notch in said opposite side edge, said notch being aligned with the score line between said lower support member and said shelf member, whereby said shelf member will extend into said notch when said lower support member is rotated around said score line between said lower support member and said shelf member and said post member is rotated around said score line between said post member and said lower support member.

7. The blank of claim 6 wherein said detachable side, bottom and top edges of said lower support member and said post are formed by cut lines, cut and score lines or perforations.

8. The blank of claim 6 in which said lower edge of said post member is aligned with said lower edge of said support member.

9. The blank of claim 1 wherein said lines forming said integral extension in the shelf member are cut lines, cut and score lines or perforations.

10. A shelf stack comprising a first shelf member, first side walls attached to said first shelf member by score lines and extending downwardly from said first shelf member, said first side walls having first integral extensions extending upwardly from said shelf member, a second shelf member, second side walls attached to said second shelf member by score lines and extending downwardly from said second shelf member, said second side walls having second integral extensions extending upwardly from said second shelf member, said second side walls resting on said first shelf member, said second side walls being within said first integral extensions, said first integral extensions extending above said second shelf member.

11. The shelf stack of claim 10 further comprising each of said first and second integral extensions having a score line thereon, said score line being located on said integral extension a distance above said shelf member a distance substantially equal to the height of said side walls.

12. The shelf stack of claim 11 further comprising each of said first and second integral extensions having a second score line thereon, said score line being located on said integral extension a distance above said shelf member a distance substantially equal to twice the height of said side walls.

13. The shelf stack of claim 10 further comprising a support member attached to said shelf member by a score line and extending downwardly from said shelf member, a post member attached to said support member by a score line and extending through an aperture in said shelf member said post member having an angular relationship with said support member, said shelf member extending into a notch in one side of said post member.

* * * * *